US010450783B2

(12) United States Patent
Prieur

(10) Patent No.: US 10,450,783 B2
(45) Date of Patent: Oct. 22, 2019

(54) DOOR-STOPPING DEVICE WITH A PLURALITY OF HOLDING POSITIONS

(71) Applicant: André Prieur, La Garenne Colombes (FR)

(72) Inventor: André Prieur, La Garenne Colombes (FR)

( * ) Notice: Subject to any disclaimer, the term of this patent is extended or adjusted under 35 U.S.C. 154(b) by 0 days.

(21) Appl. No.: 16/065,172

(22) PCT Filed: Dec. 23, 2016

(86) PCT No.: PCT/FR2016/053669
§ 371 (c)(1),
(2) Date: Jun. 22, 2018

(87) PCT Pub. No.: WO2017/109441
PCT Pub. Date: Jun. 29, 2017

(65) Prior Publication Data

US 2019/0003218 A1 Jan. 3, 2019

(30) Foreign Application Priority Data

Dec. 24, 2015 (FR) ..... 15 02695

(51) Int. Cl.
*E05C 17/22* (2006.01)
*E05C 17/20* (2006.01)

(52) U.S. Cl.
CPC ..... *E05C 17/22* (2013.01); *E05C 17/203* (2013.01)

(58) Field of Classification Search
CPC ... Y10T 16/61; Y10T 16/629; Y10T 16/6295; Y10T 292/285; Y10T 292/286;
(Continued)

(56) References Cited

U.S. PATENT DOCUMENTS 1,120,169 A * 12/1914 Tabor ..... E05C 17/18 292/266
2,268,976 A * 1/1942 Westrope ..... E05C 17/206 16/331

(Continued)

FOREIGN PATENT DOCUMENTS

CN 2152042 Y 1/1994
CN 104024550 A 9/2014

(Continued)

OTHER PUBLICATIONS

International Search Report, dated Mar. 27, 2017, from corresponding PCT application No. PCT/FR2016/053669.

(Continued)

*Primary Examiner* — Chuck Y Mah
(74) *Attorney, Agent, or Firm* — Young & Thompson

(57) ABSTRACT

A door-stopping device including a connecting arm (1) and a locking mechanism (2), one being secured to the door leaf, and the other to the frame, the connecting arm (1) including at least one face provided with a plurality of successive notches (11), in each of which a blocking element (21) can be housed, the blocking element being subjected to the effect of elastic return element (22), while a mobile carriage (3) can slide along the connecting arm (1) on which it is mounted, at the same time providing a certain resistance to movement. The mobile carriage (3) includes inclined ramps (32) for holding the blocking element (21) outside the notches (11) during the phases during which the door-locking device is in the unlocked mode. The device according is particularly applicable to motor vehicle doors.

20 Claims, 11 Drawing Sheets

(58) Field of Classification Search
CPC ... Y10T 292/304; E05C 17/025; E05C 17/04; E05C 17/12; E05C 17/20; E05C 17/203; E05C 17/206; E05C 17/22; E05C 17/26; E05C 17/24; E05C 17/28; E05C 17/18; E05F 5/025; E05F 5/08; E05F 1/1008; F05F 5/06; F05F 5/08; F05F 5/12; E05Y 2900/531; B60J 5/04
See application file for complete search history.

(56) References Cited

U.S. PATENT DOCUMENTS

| | | | | |
|---|---|---|---|---|
| 6,370,732 | B1 * | 4/2002 | Yezersky | E05C 17/203 16/82 |
| 6,711,778 | B2 * | 3/2004 | Sparkman | E05C 17/203 16/82 |
| 7,578,029 | B2 * | 8/2009 | Prieur | E05C 17/203 16/101 |
| 7,832,051 | B2 * | 11/2010 | Prieur | E05C 17/203 16/82 |
| 8,733,818 | B2 * | 5/2014 | Hooton | E05C 17/203 16/86 C |
| 9,567,787 | B2 * | 2/2017 | Prieur | E05C 17/203 |
| 9,822,570 | B2 * | 11/2017 | Jaranson | E05C 17/203 |
| 2004/0055110 | A1 * | 3/2004 | Breed | E05C 17/203 16/82 |
| 2008/0271286 | A1 * | 11/2008 | Stalhammar | E05C 17/203 16/84 |
| 2014/0053370 | A1 * | 2/2014 | Tseng | E05C 17/203 16/82 |
| 2017/0002592 | A1 * | 1/2017 | Cervantes, Jr. | E05C 17/56 |

FOREIGN PATENT DOCUMENTS

| | | | | |
|---|---|---|---|---|
| CN | 203856299 | U | 10/2014 | |
| CN | 104746980 | A | 7/2015 | |
| DE | 442 699 | C | 4/1927 | |
| EP | 0952289 | A1 * | 10/1999 | E05C 17/203 |
| FR | 2 981 108 | A1 | 4/2013 | |
| GB | 219783 | A | 8/1924 | |
| JP | S51-4619 | U | 1/1976 | |
| JP | S57-123463 | U | 7/1982 | |
| JP | 2012097482 | A * | 5/2012 | |
| KR | 20030067779 | A | 8/2003 | |

OTHER PUBLICATIONS

Office Action in Chinese Patent Application No. 201680075055.6 dated Jun. 4, 2019 with English translation provided.

* cited by examiner

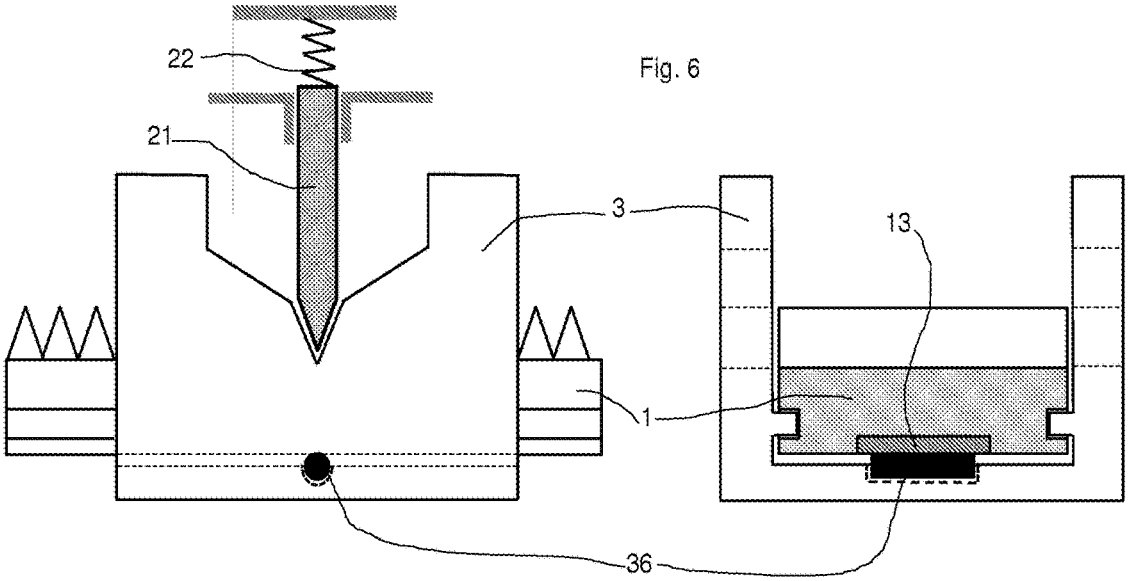
Fig. 6
Fig. 7
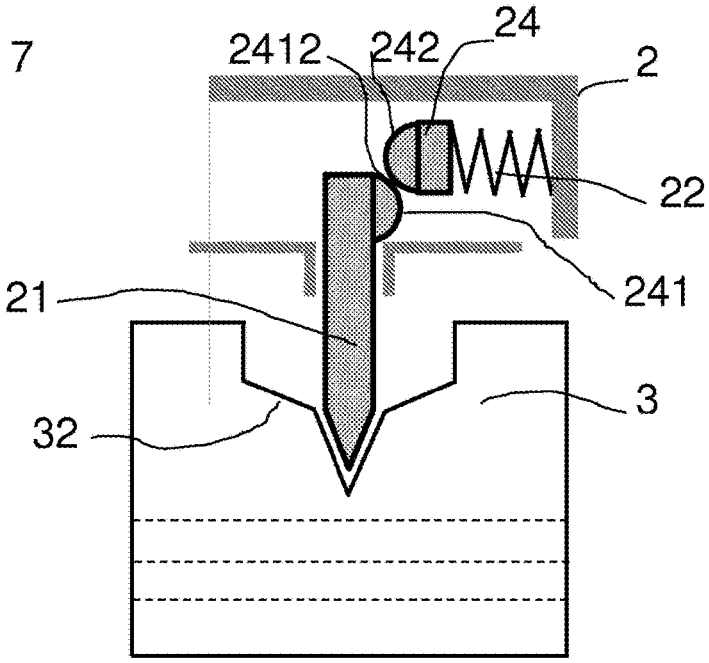

37
371
374
2
253
251
252
25
14

371
374
37
2
253
251
252
25
14

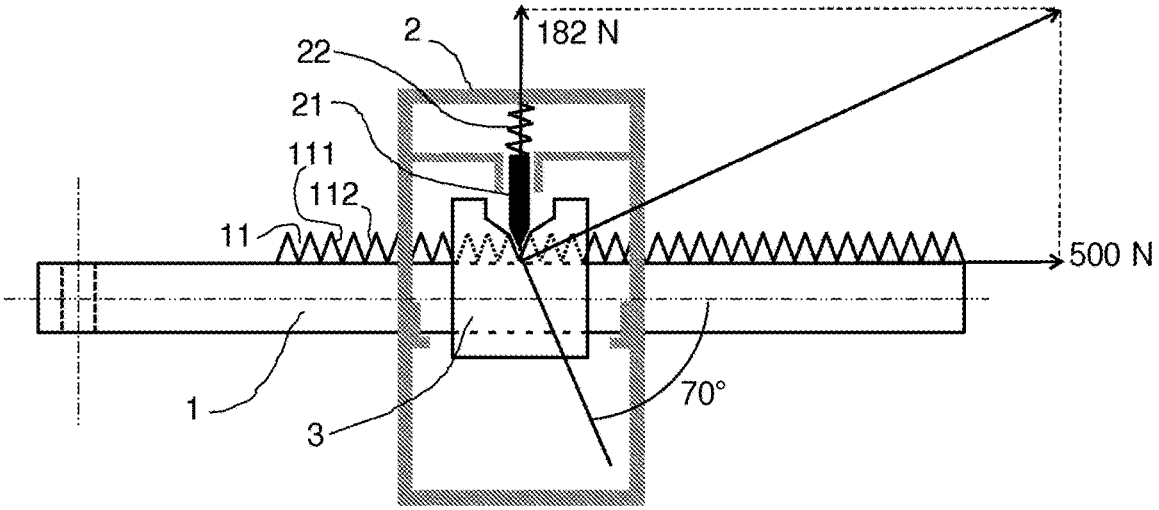
Fig. 16
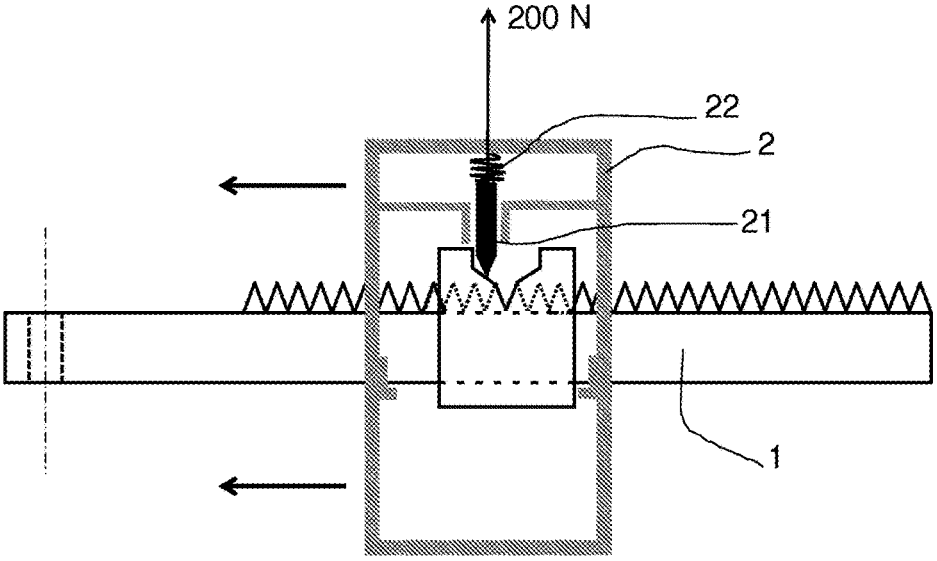

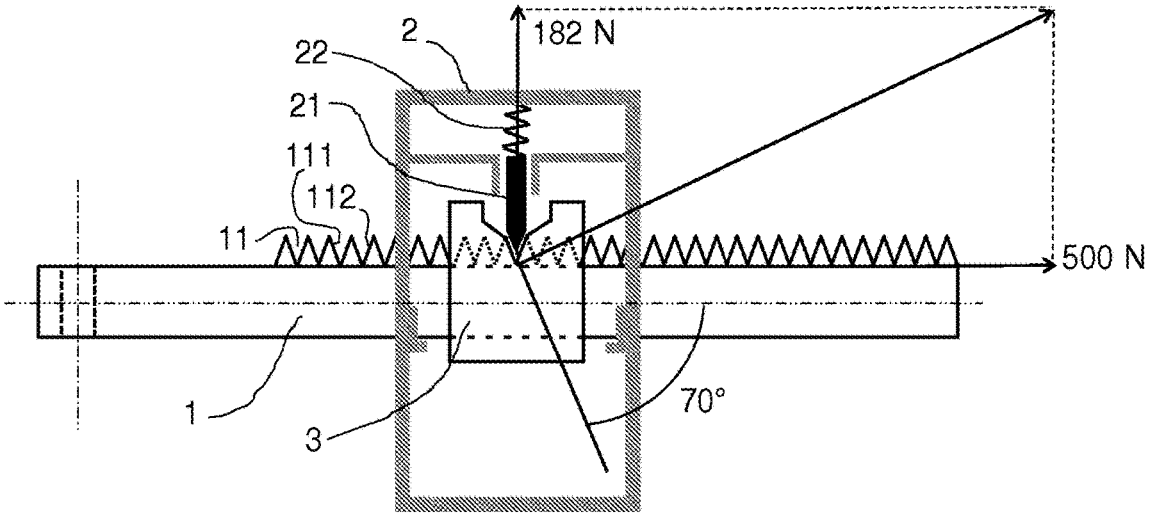
Fig. 17
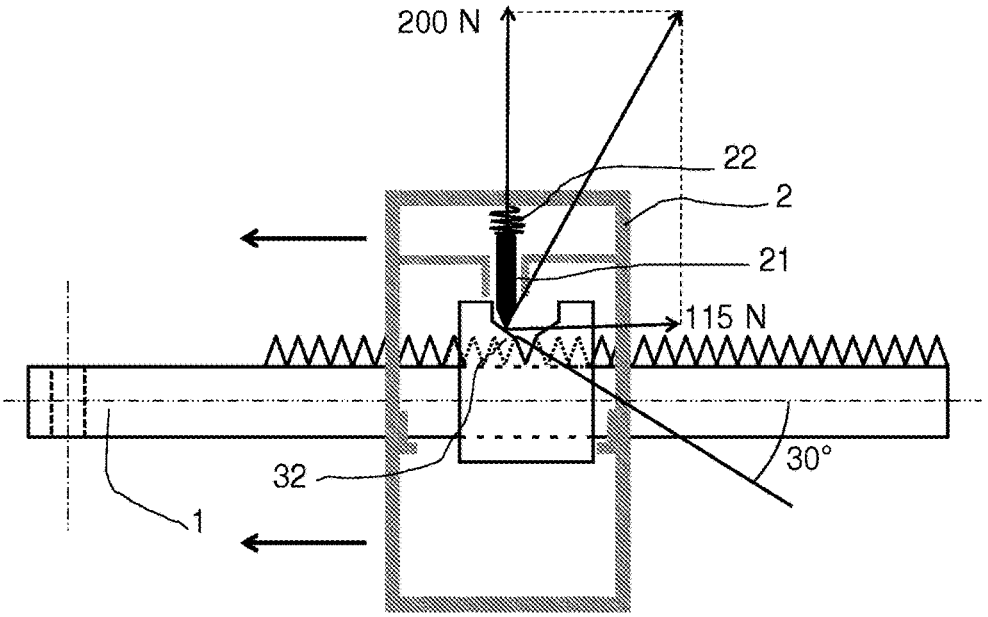

DOOR-STOPPING DEVICE WITH A PLURALITY OF HOLDING POSITIONS

BACKGROUND OF THE INVENTION

The present invention relates to a door stop device, comprising a blocking mechanism and a connecting arm, one of these two elements being fastened to the opening part of the door, the other element being fastened to the frame of the door, the said connecting arm comprising multiple retaining notches and the said blocking mechanism comprising at least one blocking element pressed by elastic means inside anyone of the retaining notches of the connecting arm, making it possible in this way to retain the door open in anyone of the multiple retaining positions defined by the said connecting arm's retaining notches.

The invention is within the field of door stop devices with applications more specifically in the area of motor vehicles, the building sector and household appliances.

Some door stop devices are known as the one described in document FR 2 981 108, making it possible to retain a swinging or sliding door in any indeterminate position, between closed and fully open, as long as the required opening or closing force is not applied, with possible applications specifically in the area of automobile doors.

The door stop device with indeterminate retaining positions as described in document FR 2 981 108 comprises specifically:

- An articulated arm, formed by a metallic rod or any other resistant material, providing rolling tracks on two opposite sides.
- A mechanism comprising blocking means for the articulated arm, the release of these blocking means being triggered by a traction effort beyond a predefined threshold applied to the said mechanism in a direction globally parallel to the articulated arm.

More specifically, the blocking mechanism comprises a braking element which holds a braking roller against the said articulated arm, the rotation axle of the said braking roller being mounted in a way to allow a movement globally parallel to the said articulated arm and with a limited amplitude relative to the blocking mechanism, which also comprises elastic means intended to push the said braking roller and the said braking element against each other.

- A mobile interface unit, itself mounted to the blocking mechanism and which is allowed to move in a direction globally perpendicular to the articulated arm, comprises bearing means which cooperate with the axle of the braking roller, in order to transfer to the said axle, the efforts produced by the elastic means with different variable inclined directions, in a way that according to one embodiment, the said braking roller is in a blocked position when being in contact with the braking element, and otherwise the said braking roller may rotate freely when being set apart from the braking element.

The braking roller's structure and its constituent materials are specifically adapted to its functionnality. In addition, the articulated arm may be featured with notches or bosses located on its said rolling tracks, in order to improve the grip of the braking roller.

However, this door stop device is known to generate a large relative movement between the the blocking mechanism and the articulated arm when the door stop device returns to the locked position, because in this case, the mobile interface device transfers the forces provided by the elastic means to the axle of the braking roller, which generates a movement of the said axle, while the braking element is in contact with the braking roller. As a result, the articulated arm which is driven by the braking roller, moves over a distance which is twice the distance traveled by the axle, due to the leverage effect. Consequently, the door stop's hold position is not accurate.

The present invention proposes a solution to overcome this problem, while making the door stop device substancially simpler: the present invention provides that the blocking element cooperates directly with the articulated arm and no longer through a braking roller comprising an axle, whereas a mobile carriage, comprising inclined ramps, may slide along the articulated arm, while holding the blocking element when the door stop device is in unlocked mode.

In this regard, the invention is related to a door stop device, comprising a blocking mechanism and a connecting arm, one of these two elements being fastened to the opening part of the door, the other element being fastened to the frame of the door, the said blocking mechanism comprising at least one blocking element pressed against the said connecting arm, whereas a mobile carriage may slide with a longitudinal movement along the said connecting arm, within specified limits relative to the body of the said blocking mechanism, which also comprises elastic means designed to press the blocking element against the said connecting arm, wherein:

- the said connecting arm comprises multiple retaining notches which may hold the said blocking element, enabling the door stop device to be locked in multiple different positions.
- the said mobile carriage may slide along the said connecting arm to which it is mounted, while providing some resistance to movement, enabling in this way the said blocking element to be kept in unlocked mode, pressed against some inclined ramps which are part of the said mobile carriage, whenever a relative movement takes place between the connecting arm and the blocking mechanism; the door stop device is, in this case, in unlocked mode. The relative resistance to movement between the connecting arm and the mobile carriage may be simply obtained by some friction generated between two contacting surfaces belonging respectively to the said connecting arm and mobile carriage, but also be obtained by adding a braking device consisting of a brake pad linked to the said mobile carriage and pressed by elastic means against a surface belonging to the said connecting arm.
- the said blocking element which is pressed by some elastic means against one of the retaining notches provided on the connecting arm, is itself mounted to the blocking mechanism, with a relative mobility in a direction globally perpendicular to the connecting arm, in such a way that the said blocking element may be removed from the retaining notches of the said connecting arm in order to release this one.
- the elastic means are mounted to the blocking mechanism and cooperate directly or indirectly with the blocking element in a direction comprising a component globally perpendicular to the connecting arm. The elastic means may be made of a metallic or a plastic assembly, or made of a blend of these materials, for example an assembly comprising a helicoidal spring or elastic blades, or even a deformable element, like a part made of elastomer material.

Other purposes and advantages of the present invention will appear in the description hereafter, which relates to an embodiment of the device proposed by the invention, to be considered as a non limitative example and the understanding of which can be made easier by refering to the drawings enclosed, which constitute a schematic embodiment of the device proposed by the invention.

BRIEF DESCRIPTION OF THE DRAWINGS

FIG. 6: cylindrical roll (36) cooperating with deformable part (13).

FIG. 7: variation of elastic means (22) in locked mode.

FIG. 16: example of possible forces on connecting arm (1) and blocking element (21).

FIG. 17: example shown in FIG. 16, with blocking mechanism (2) in unlocked mode.

DETAILED DESCRIPTION OF THE INVENTION

Figure 1:
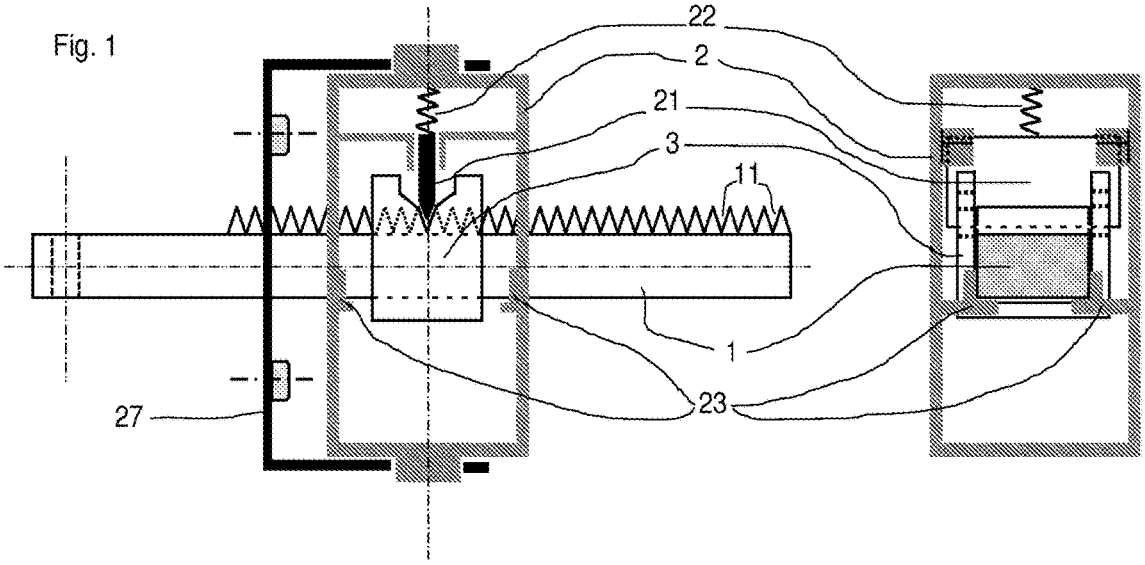
FIG. 1: schematic drawing of the door stop device comprising a connecting arm (1) and a blocking mechanism (2).

An example of embodiment of the door stop device proposed by the present invention is formed by (FIG. 1):

A connecting arm (1), preferably articulated at one end, being fastened to the opening part of the door or to the frame of the door, advantageously formed by an elongated rod having preferably a rectilinear shape, made of a resistant material, as metal or plastics used in the design of mechanical parts, providing at least one side comprising multiple successive retaining notches (11), in each of which the blocking element (21) described hereafter may be held, providing in this way the blocking function of the door stop device in multiple different positions. For the sake of simplification, the retaining notches (11) will be illustrated herein with a triangular cross-section. It is easy to understand that the deeper and more steep-sided the retaining notches (11) are, then larger will be the effort needed to release the blocking element (21), which allows to define the hold force provided by the door stop device. The connecting arm (1) may comprise at least one, but preferably two grooves (12) (FIG. 2), on one or several of its sides, in order to host at least one, but preferably two ribs (33) belonging to the mobile carriage (3) described hereafter, in order to insure a relative mounting of the said mobile carriage (3) to the connecting arm (1), while enabling a longitudinal sliding of the said mobile carriage (3) along the connecting arm (1). Lastly, the connecting arm (1), which is mobile relative to the blocking mechanism (2) described hereafter, is designed to be guided through the said blocking mechanism (2), by sliding along at least one support zone (23) belonging to the body of said blocking mechanism (2), (FIG. 1), in order to react the loads applied essentially by the blocking element (21) to the connecting arm (1). The support zone (23) belonging to the body of the blocking mechanism (2) may, for example, be made of one or several flat and smooth surfaces located in the vicinity of the openings provided in the body of the blocking mechanism (2), to allow the connecting arm (1) through. The support zone (23) may be easily made by a skilled person and will simply be shown here graphically.

A blocking mechanism (2) (FIG. 1), which is mobile relative to the connecting arm (1) and which may be linked to the opening part of the door or to the frame of the door, preferably by the means of a hinge connection with an axis perpendicular to the longitudinal axis of the connecting arm (1), shown here as the schematic drawing of a mounting bracket (27), the said blocking mechanism (2) being designed to cooperate with the said connecting arm (1), in order to hold the connecting arm (1) blocked in one of the multiple positions defined by the retaining notches (11) belonging to the connecting arm (1), as long as the door is not submitted to a load that would exceed the predefined unlocking force.

Figure 2:
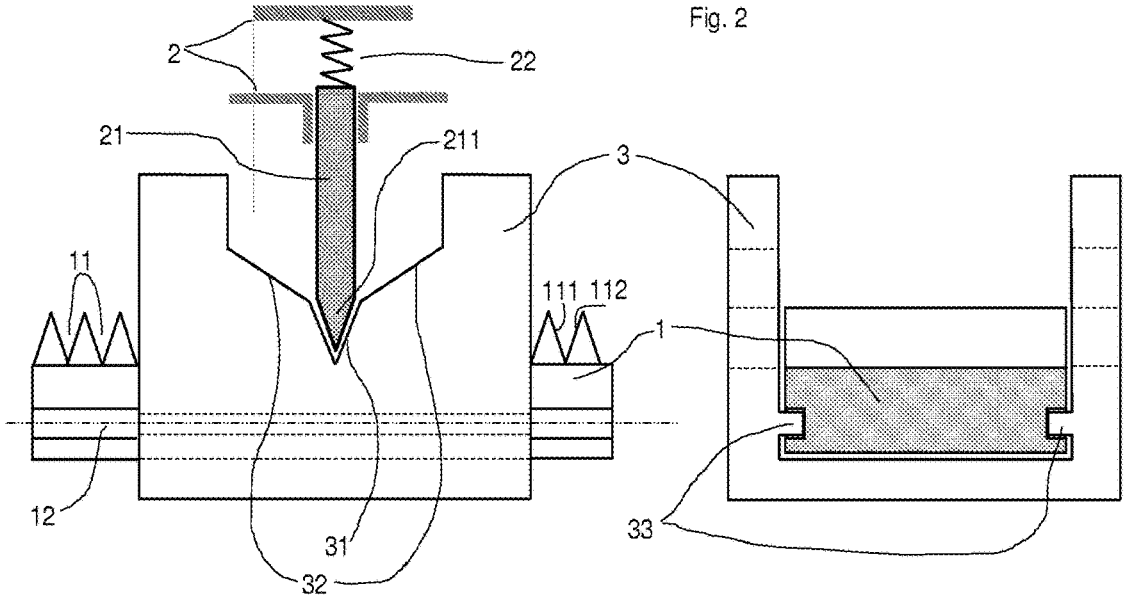
FIG. 2: connecting arm (1), blocking mechanism (2) and mobile carriage (3).
Figure 3:
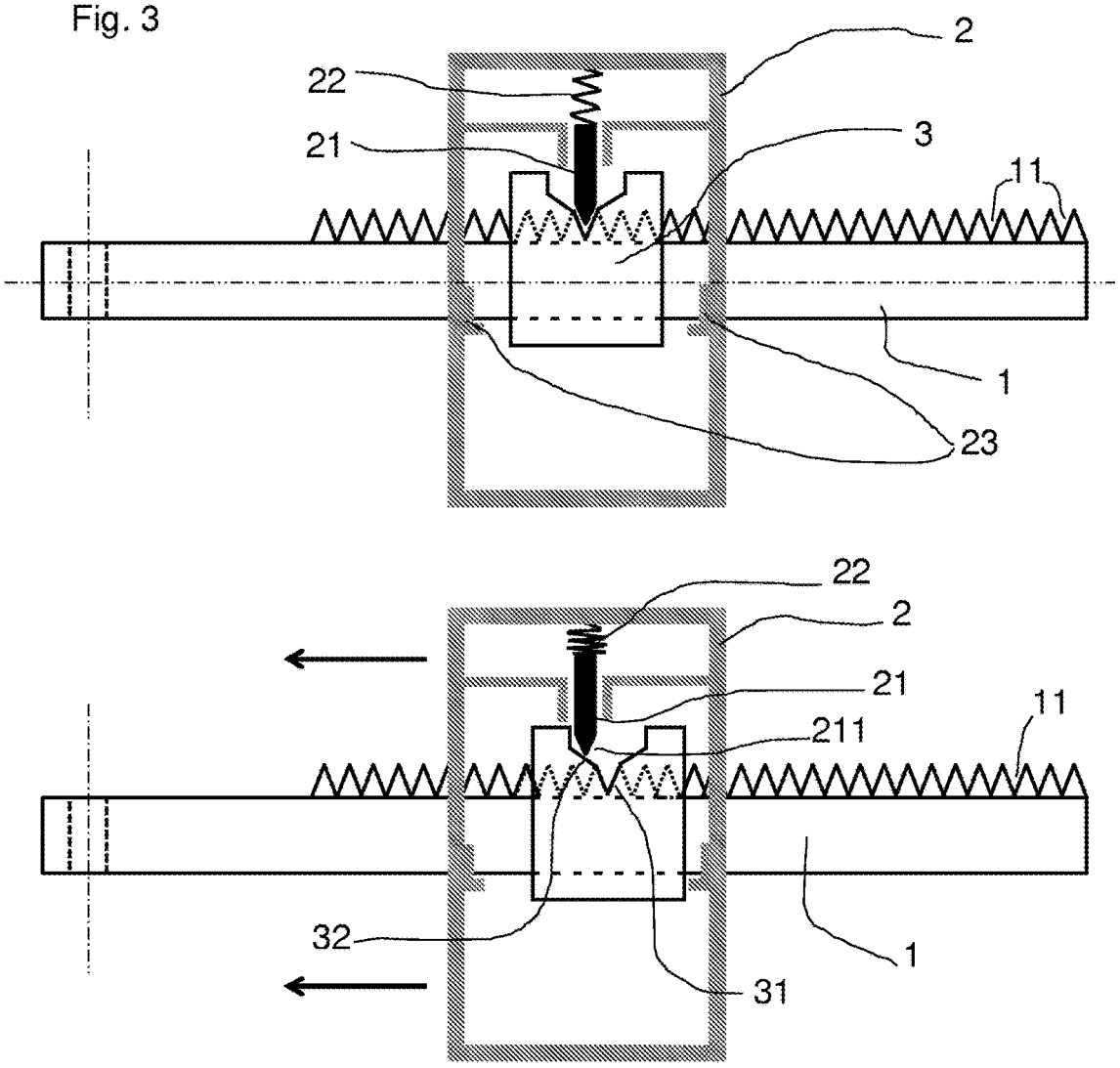
FIG. 3: door stop device in locked and unlocked modes.

The said blocking mechanism (2) comprises (FIG. 1):

a blocking element (21), which may cooperate with anyone of the retaining notches (11) provided on the connecting arm (1), the said blocking element (21) being submitted to the forces provided by the elastic means (22), and also the said blocking element (21) being mounted to the blocking mechanism (2) and allowed to move in a direction globally perpendicular to the connecting arm (1), in a way that the said blocking element (21) may be set apart from the connecting arm (1), in order to release the said connecting arm (1) (FIG. 3). In the present embodiment example for this invention, the blocking element (21) will comprise a triangular extremity (211), intended to match with the triangular shape of the retaining notches (11) (FIG. 2).

Also, as a pure example, we shall assume that the sides (111) and (112) of the notches (11), form an angle of 70° with the longitudinal axis of the connecting arm (1), (FIG. 16). Consequently, for a longitudinal hold force supposed to be for example 500 N between the connecting arm (1) and the blocking mechanism (2), the load which needs to be provided by the blocking element (21) in a direction perpendicular to the connecting arm (1), will be equal to: (500 N/Tangent 70°), or (500 N/2,747)=182 N. This load of 182 N is a result of a relative compression of the elastic means (22). It is easy to understand that if the 500 N threshold for the hold force of the connecting arm (1) is exceeded, then the perpendicular load resulting on the blocking element (21) becomes larger than 182 N and overcomes the load provided by the elastic means (22), and consequently the said blocking element (21) is removed from the retaining notch (11). Also, we shall assume in this specific example, that the stiffness coefficient of the elastic means (22), as well as the distance traveled by the blocking element (21) to completely leave the retaining notch (11), are such that the increase of the load resulting from the additional compression of the elastic means (22), is equal to 10% of the initial load of 182 N, which gives a global load of 200 N applied onto the blocking element (21) by the time it leaves the retaining notch (11).

elastic means (22) which are mounted to the blocking mechanism (2), being fastened to a part of the body of the blocking mechanism (2), as for example one side of the body of blocking mechanism (2) as simply shown by schematic drawing on FIG. 2, which elastic means (22) may easily be made by a skilled person. The invention provides that the said elastic means (22) may cooperate directly or indirectly with the blocking element (21), in a direction globally perpendicular to the connecting arm (1). The elastic means (22) may be made of a metallic or a plastic assembly, or made of a blend of these materials, for example an assembly comprising a helicoidal spring or elastic blades, or even a deformable element, as a part made of elastomer material. For the sake of clarity, the elastic means (22) will be simply illustrated herein as a helicoidal spring.

a mobile carriage (3), (FIG. 2), which may slide along the connecting arm (1) to which it is mounted, while the longitudinal movement may be secured by at least one, but preferably two ribs (33), adapted to slide along at least one, but preferably two grooves (12) belonging to the connecting arm (1), while providing some resistance to movement, allowing in this way the said blocking element (21) to be kept in unlocked mode, pressed against the inclined ramps (32) belonging to the said mobile carriage (3), described hereafter, whenever a relative movement appears between the connecting arm (1) and the blocking mechanism (2); the door stop device is, in this case, in unlocked mode.

Figure 4:
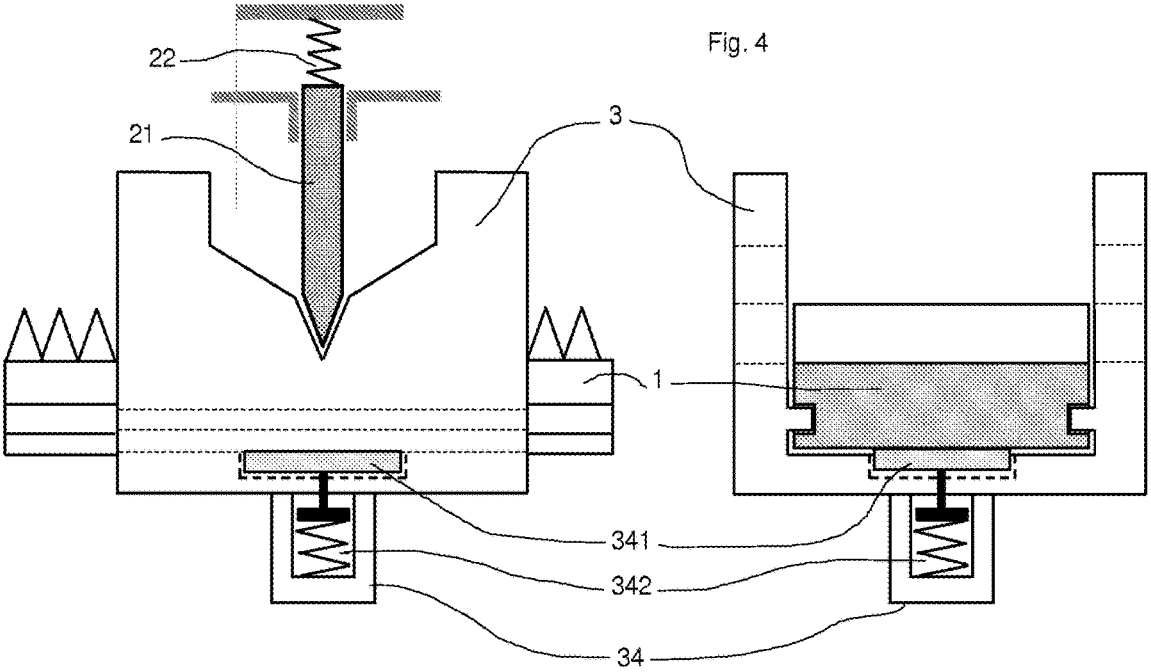
FIG. 4: braking device (34) intended to cooperate with connecting arm (1).
Figure 5:
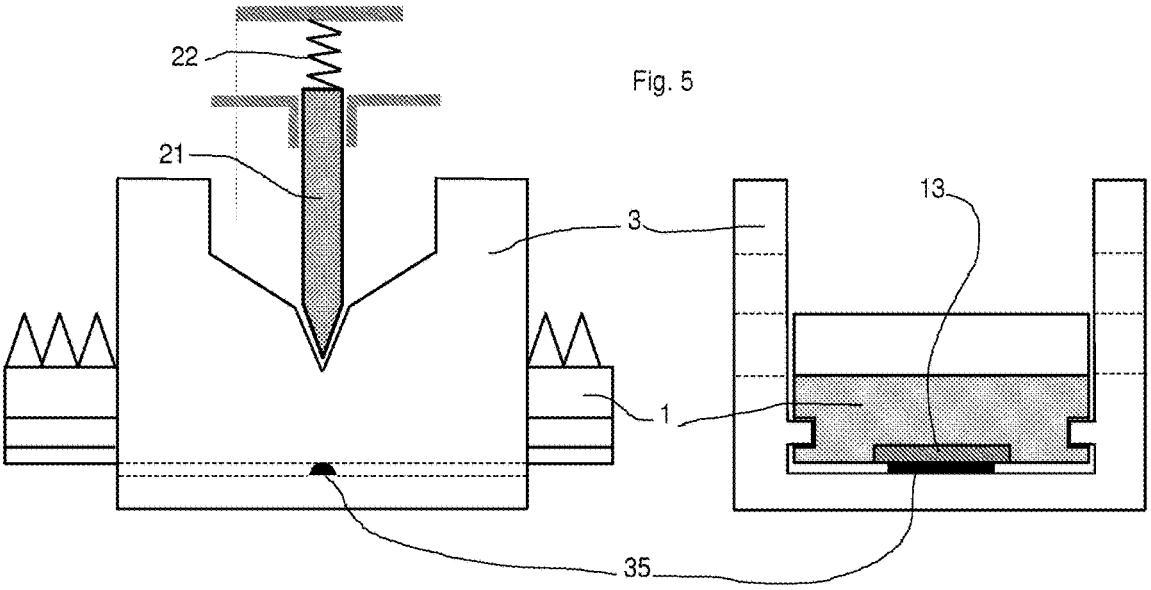
FIG. 5: embossment (35) intended to cooperate with deformable part (13).

The relative resistance to movement between the connecting arm (1) and the mobile carriage (3) may be obtained simply by some friction generated between two contacting surfaces belonging respectively to each of these two latter elements, but also obtained by adding a braking device (34) which may consist of a brake pad (341) linked to the mobile carriage (3) and pressed by some elastic means (342) against a surface belonging to the connecting arm (1). (FIG. 4). Also, the relative resistance to movement between the connecting arm (1) and the mobile carriage (3) may be obtained by the deformation of a deformable part (13) located on one side of the connecting arm (1), the said deformable part (13) being pressed against an embossment (35) belonging to the mobile carriage (3) (FIG. 5), or otherwise pressed against a cylindrical roll (36) (FIG. 6), which may freely rotate inside a semi-cylindrical cavity belonging to a part of the mobile carriage (3) which will be facing the deformable part (13). The said deformable part (13) may, for example, be made of elastomer materials. Also, according to the invention, the mobile carriage (3) comprises at least one, but preferably two notches (31), having a shape globally identical to the retaining notches (11) of the connecting arm (1), and the mobile carriage (3) also comprises at least two inclined ramps (32) located on either sides of each of the said notches (31). (FIG. 2). The invention also provides that the inclination of the said inclined ramps (32) relative to the longitudinal axis of the connecting arm (1), will be preferably less steep than the inclination of the sides of the notch (31), in order to reduce the force component which is parallel to the longitudinal axis of the connecting arm (1), and which results from the load transmitted by the blocking element (21) to the said inclined ramps (32). According to the invention, the notches (31) of the mobile carriage (3), are designed to receive a part of the extremity (211) of the blocking element (21), and the said notches (31) will, for this reason, preferably be located side by side with the retaining notches (11) of the connecting arm (1), in such a way that when the blocking element (21) is located inside a retaining notch (11) in a locked position, then the notches (31) of the mobile carriage (3) will be located beside and aligned with one of the retaining notches (11) above, due to the load applied by the blocking element (21). Whenever the connecting arm (1) is submitted to a force above a given threshold, the blocking element (21) is moved apart from the set composed of one of the retaining notches (11) and of the notch (31), up to the point where the blocking element (21) is no longer inside the retaining notch (11) of the connecting arm (1), the said blocking element (21) being from this point only held by the parts of its extremity (211) which were inside the notches (31) of the mobile carriage (3), and which are, from now on, only held by the inclined ramps (32), (FIG. 3). In this configuration, the connecting arm (1) is no longer blocked in translatory movement by the blocking element (21) and the door stop device is in unlocked mode. During this unlocked phase, the mobile carriage (3) is mainly submitted to two opposite forces which are in a direction parallel to the longitudinal axis of the connecting arm (1) and which are balanced. One of these forces results from the load exerted by the blocking element (21) on the inclined ramps (32) of the mobile carriage (3); the component of this resulting load which is parallel to the longitudinal axis of the connecting arm (1) is balanced by a resistance to movement which is due to the friction force applied to the mobile carriage (3), as a result of the movement of the said mobile carriage (3) relative to the connecting arm (1), the said friction force being intentionally defined with a limited amplitude. As soon as the relative movement between the connecting arm (1) and the blocking mechanism (2) ceases, whenever the door is left open in any position, then the friction force disappears, which interrupts the balance between the forces, and the blocking element (21), submitted to the elastic means (22), forces its extremity (211) inside the one retaining notch (11) which is located in front of the blocking element (21), while the blocking element (21) also forces the notches (31) of the mobile carriage (3) to be aligned with the one retaining notch (11) here above. The door stop device is then back in a locked position. It may be noticed that the notches (31) of the mobile carriage (3) could be placed somewhere else than just beside the retaining notches (11), for example in a position slightly different due to limited available space, without modifying the present invention. In this case, it would then be necessary to adapt the blocking element (21) accordingly, by providing one element that may be a substitute to the extremity (211) of the blocking element (21) and that may cooperate with the notches (31). To come back to the numerical example proposed here above as an illustration, it will be noted that for a 200 N load provided by the blocking element (21) on the inclined ramps (32) of the mobile carriage (3), and assuming for example, that the said inclined ramps (32) would form a 30° angle with the longitudinal axis of the connecting arm (1), (FIG. 17), then the component force which is parallel to the longitudinal axis of the connecting arm (1) and which is transmitted to the mobile carriage (3) will be equal to: (200 N×Tangent 30°), or (200 N×0,577)=115 N. Consequently, the balancing of forces requires that the load provided by the friction between the mobile carriage (3) and the connecting arm (1), be at least equal to 115 N, in this specific case described as an example.

Figure 8:
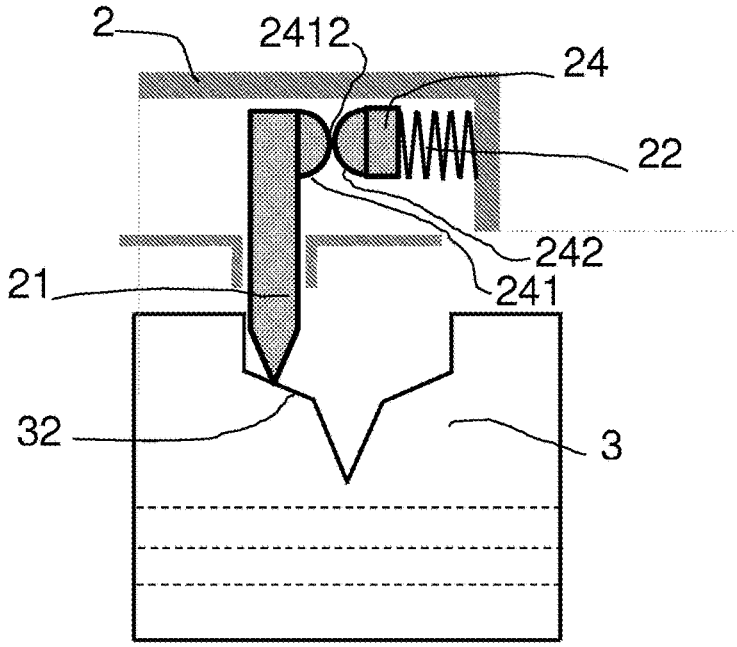
FIG. 8: variation of elastic means (22) in unlocked mode.
Figure 18:
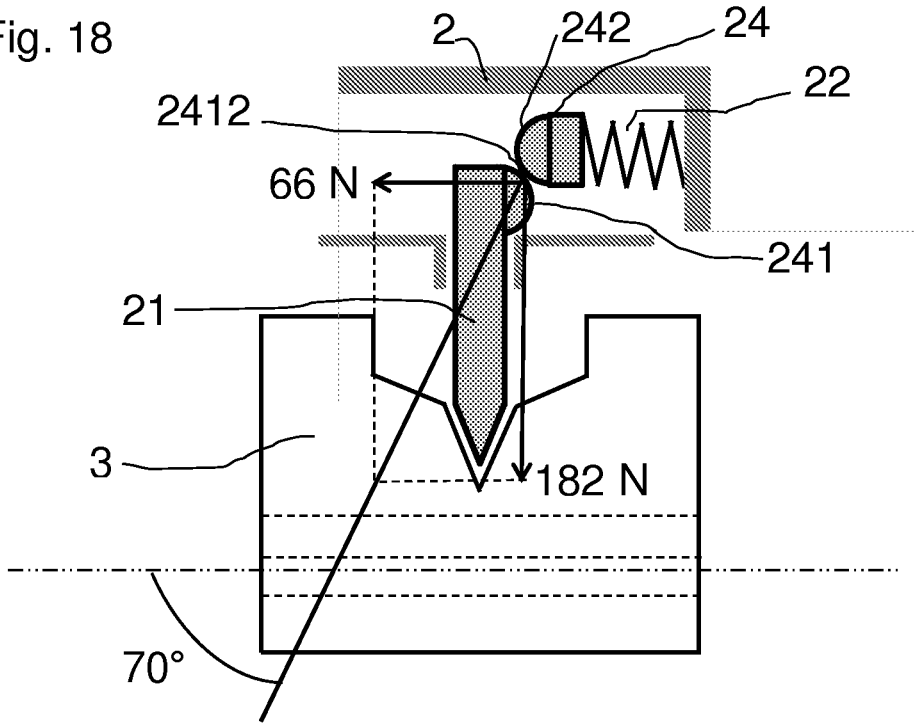
FIG. 18: example of possible forces on blocking element (21) according to the variation of elastic means (22) shown in FIG. 7.
Figure 19:
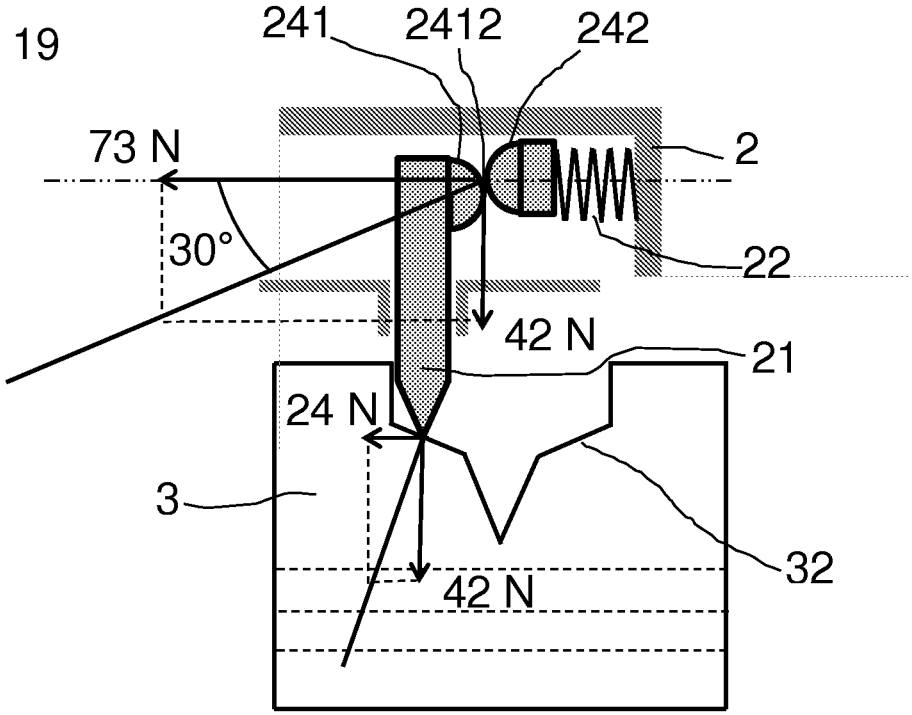
FIG. 19 example shown in FIG. 18, with blocking mechanism (2) in unlocked mode.

Variation of the elastic means (22): in a preferred embodiment, a variation of the elastic means (22) may be obtained by adding a transmission part (24) (FIG. 7), provided between the elastic means (22) and the blocking element (21), the said transmission part (24) comprising at least two surface elements (241) and (242) having a surface with a curved portion, and with some mobility relative to each other, whereas these surface elements (241) and (242) may slide along guides which are linked to the blocking mechanism (2) and which will not be described herein, the movement of the two surface elements (241) and (242) being in two perpendicular directions relative to each other. The said surface elements (241) and (242) cooperate in order to transfer the load provided by the elastic means (22), in a way that the direction of the force transmitted at the contact point (2412) between the 2 surface elements (241) and (242), may change while the elastic means (22) are compressed. In this way, when there is a small angle defined by the direction of the force transmitted at the contact point (2412) and the direction of the force resulting from the compression of the elastic means (22), then there is a small component force acting on the blocking element (21), component force which is perpendicular to the direction of the force provided by the elastic means (22); this is an advantage in unlock mode (FIG. 8). Conversly, when the angle defined by the direction of the force transmitted at the contact point (2412) and the direction of the force resulting from the compression of the elastic means (22), is close to 90°, the perpendicular component acting on the blocking element (21) is large, which is an advantage in locked mode (FIG. 7). The purpose here, is to reduce the load of the blocking element (21) on the inclined ramps (32) of the mobile carriage (3), whenever the door stop device is in unlock mode, which then makes it possible to reduce the friction force between the connecting arm (1) and the mobile carriage (3), the said friction force being required to balance the forces applied to the mobile carriage (3) in the unlock mode. Moving the door while it is in unlock mode, then requires less effort. One may notice that according to a preferred embodiment and without modifying the invention, the surface elements (241) et (242) may be integrated respectively, to the blocking element (21), as an embossment, in the case of the surface element (241), and integrated to the elastic means (22), in the case of the surface element (242), as for example, when the elastic means (22) are made of elastic blades having a curved extremity. To make an illustration based on the numerical example here above, one may notice that for a load of 200 N transmitted by the blocking element (21) when the elastic means (22) are compressed, the component force transmitted by the blocking element (21) to the mobile carriage (3), and which is parallel to the longitudinal axis of the connecting arm (1), will be equal to 115 N in the unlock mode of the door stop device. Otherwise, to reach a longitudinal hold force of 500 N between the connecting arm (1) and the blocking mechanism (2) in the locked mode of the door stop device, the force that the blocking element (21) should provide is equal to 182 N. Assuming, for example, that the direction of the force transmitted at the contact point (2412) would form an angle of 70° with the longitudinal axis of the connecting arm (1) in the locked mode of the door stop device, a force equal to 182 N may be obtained on the blocking element (21) as a result of a compression force provided by the elastic means (22), which should be equal to: (182 N/Tangent 70°)=(182 N/2,747)=66 N, (FIG. 18). Also, assuming that, in this specific case, the stiffness coefficient of the elastic means (22), as well as the distance traveled by the blocking element (21) to completely be removed from the retaining notches (11), are such that the increase of the load provided by the elastic means (22), as a result of their compression, be equal to 10% of the initial load of 66 N; then the said elastic means (22) would provide a force equal to 73 N in this compressed state, corresponding to the unlock mode of the door stop device, (FIG. 19). Assuming otherwise that, for example, the direction of the force transmitted at the contact point (2412) would form an angle of 30° with the longitudinal axis of the connecting arm (1), a force equal to 73 N provided by the elastic means (22), would generate a load on the blocking element (21), which is equal to: (73 N×Tangent 30°)=(73 N×0,577)=42 N, and the component force which is parallel to the longitudinal axis of the connecting arm (1) and which is transmitted to the mobile carriage (3) by the said blocking element (21), being itself pressed against the inclined ramp (32), will be equal to: (42 N×Tangent 30°), or (42 N×0,577)=24 N in the unlocked mode of the door stop device, which is much more advantageous than 115 N obtained previously.

Figure 9:
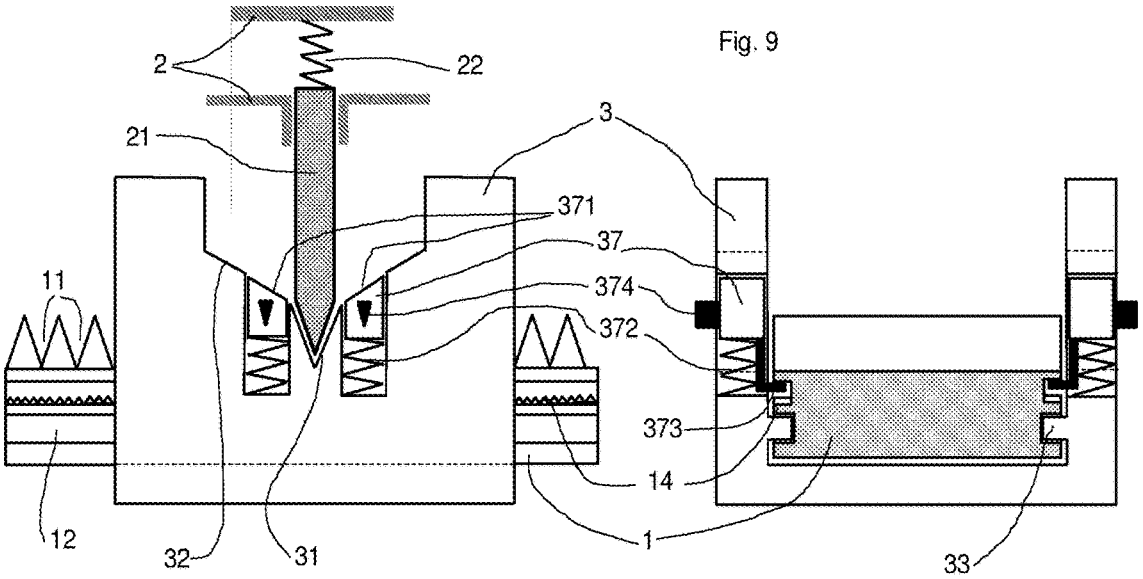
FIG. 9: variation of mobile carriage (3) comprising a braking device (37).
Figure 10:
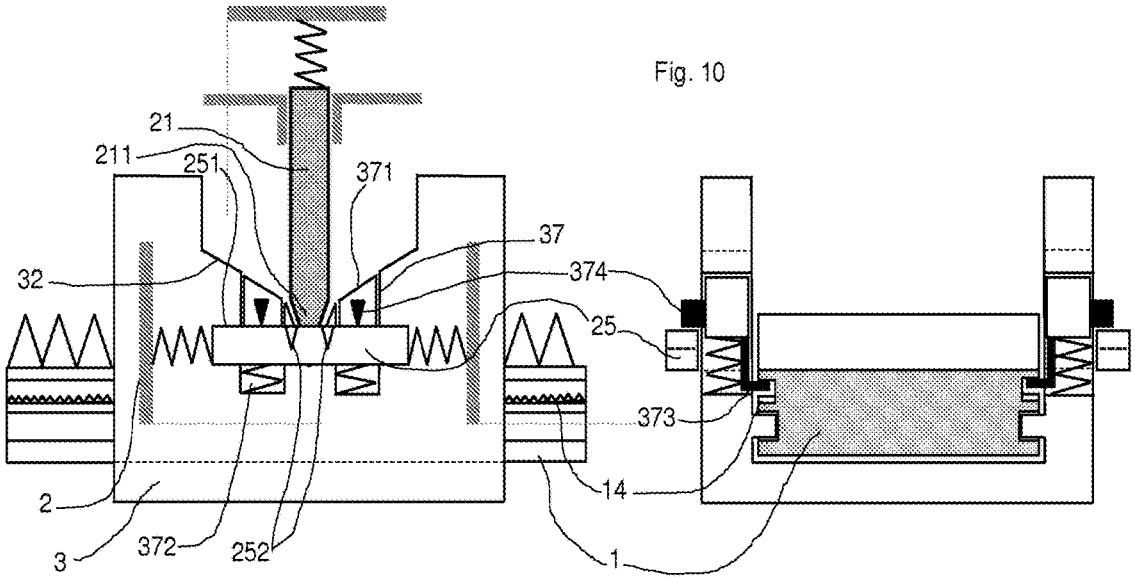
FIG. 10: variation shown in FIG. 9, showing the mobile lock (25).
Figure 11:
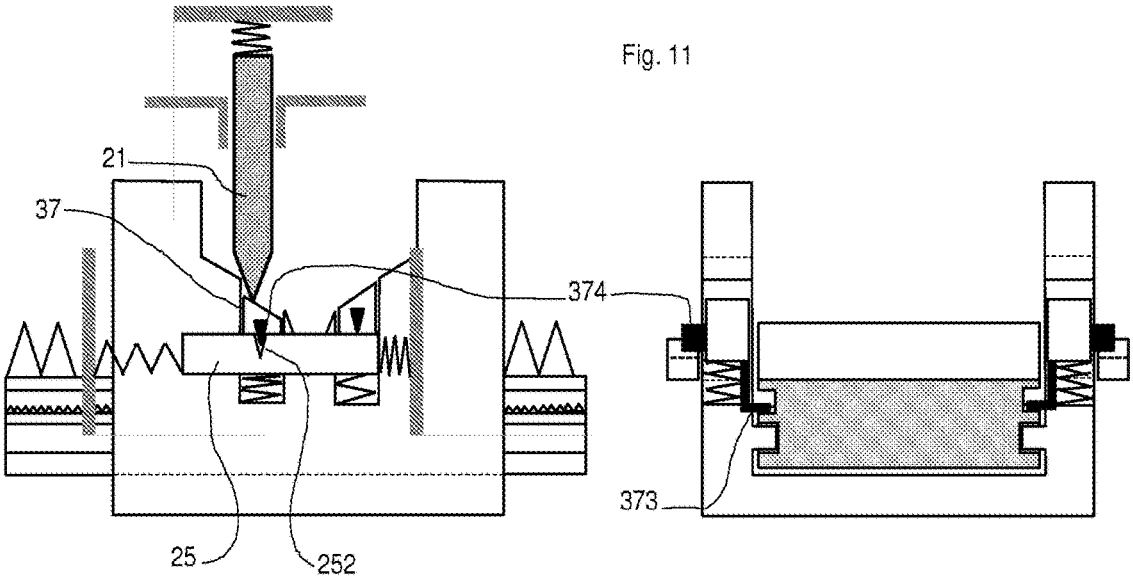
FIG. 11: variation shown in FIG. 9, during the unlocking phase.
Figure 12:
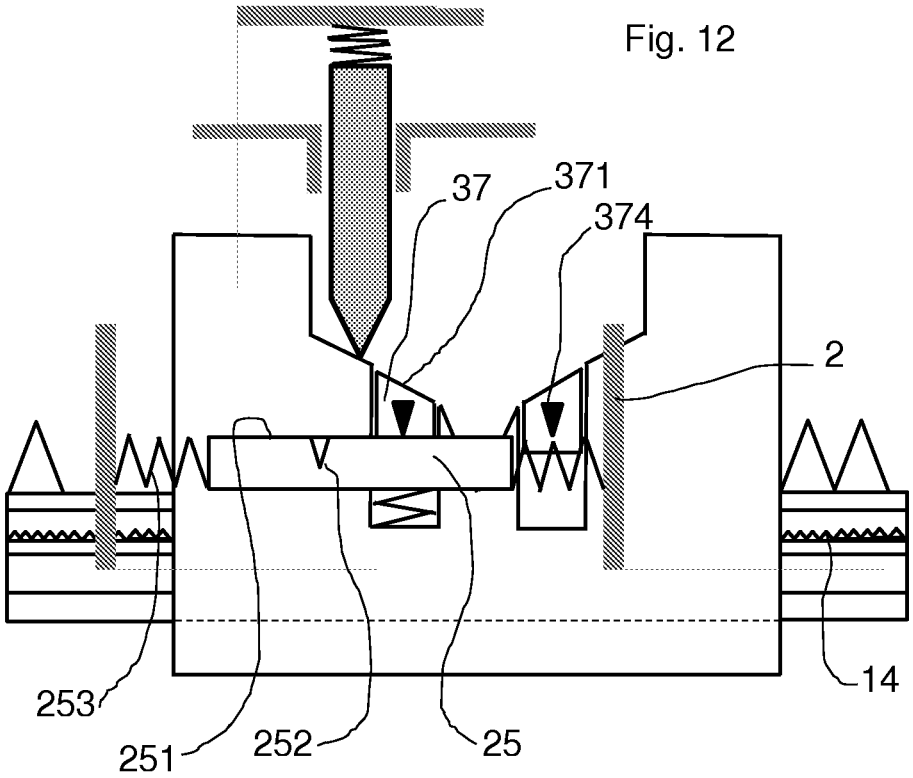
FIG. 12: variation shown in FIG. 9, with door stop device in unlocked mode.
Figure 13:
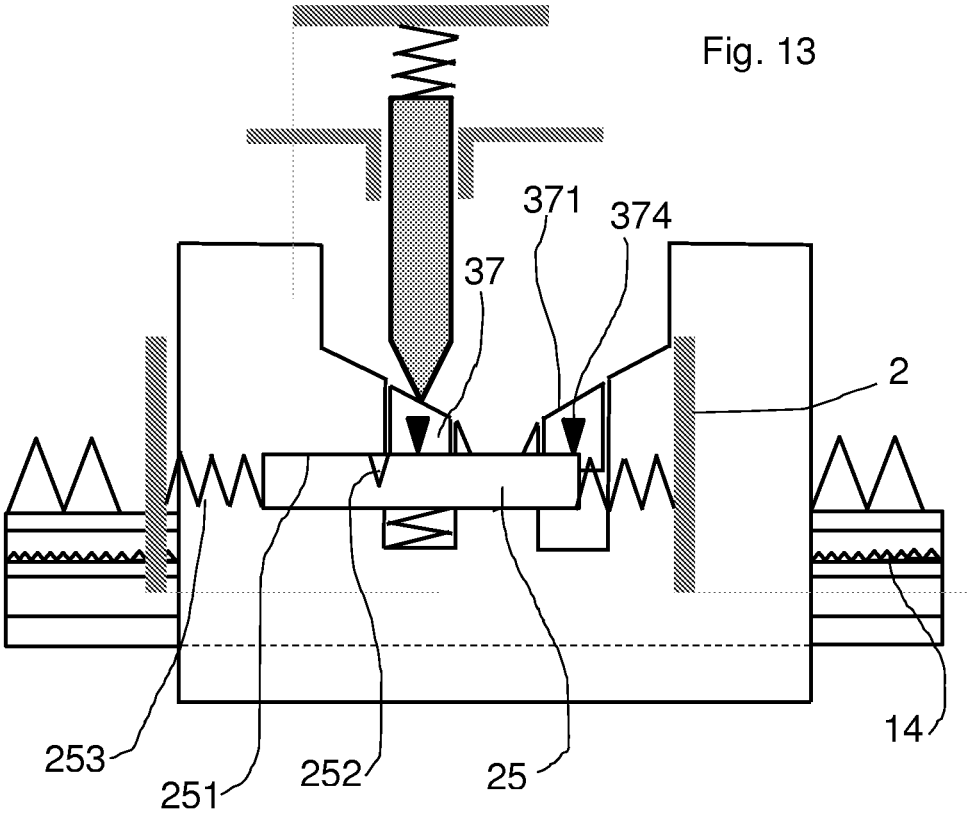
FIG. 13: variation shown in FIG. 9, with door stop device in re-locking phase.

Variation of the mobile carriage (3) (FIG. 9): in a preferred embodiment, a variation of the mobile carriage (3) may be obtained by adding at least one braking device (37) placed as a part of the inclined ramps (32), immediately next to the notch (31) and providing inclined ramps (371), which take the place of a portion of the said inclined ramps (32); the function of the said braking device (37) is to limit the motion of the mobile carriage (3) relative to the connecting arm (1), while the blocking element (21) is pressed against the inclined ramps (371) of the said braking device (37), just after the blocking element (21) has been removed from one of the retaining notches (11) of the connecting arm (1), during the unlocking phase of the blocking mechanism (2). This feature is intended to facilitate the unlocking of the blocking mechanism (2), in the case when the friction force needed to balance the loads during the unlock mode would become insufficient as, for example, if some wear appears on one of the surface elements designed for friction between the connecting arm (1) and the mobile carriage (3). The invention also provides that during the re-locking phase of the blocking mechanism (2), the said braking device (37) may be inhibited by the means of a mobile lock (25) described hereafter (FIG. 10), in a way that the said braking device (37) would no longer exert any braking on the connecting arm (1). This configuration allows the blocking element (21), which applies a pressure on the inclined ramp (371) of the braking device (37), to generate a relative sliding movement between the carriage (3) and the connecting arm (1); this helps the triangular extremity (211) of the blocking element (21) to be engaged again into the notches (31) of the mobile carriage (3) for re-locking. Therefore, the braking device (37) is mounted to the mobile carriage (3) with a relative mobility of a limited amplitude, in a direction which is globally perpendicular to the longitudinal axis of the connecting arm (1). Also, the braking device (37) will be linked to the mobile carriage (3) by some elastic means (372), which are intended to bring the inclined ramp (371) back in a position where it is aligned with the inclined ramp (32), when no load is exerted by the blocking element (21) on the braking device (37). Also, the braking device (37) includes at least one pin (373) intended to be pressed against a suitable part (14) of the connecting arm (1), in order to provide some resistance to movement between the braking device (37) and the connecting arm (1). The said suitable part (14) of the connecting arm (1) may be made of at least one longitudinal groove placed on at least one side of the connecting arm (1), the said groove having a surface state which is sufficiently rough or also a notching made of alternating hills and valleys which provide some resistance to movement between the pin (373) of the braking device (37) and the said suitable part (14) of the connecting arm (1). Also, the braking device (37) includes at least one pin (374) intended to cooperate with a surface element (251) belonging to the mobile lock (25); the pin (374) may slide relative to the mobile lock (25), in order to inhibit the resistance to movement. Also, the mobile lock (25) includes at least one notch (252), intended to receive the pin (374) when the braking device (37) is pressed by the blocking element (21) during the unlocking phase of the blocking mechanism (2) (FIG. 11). The invention provides that the mobile lock (25) is linked to the blocking mechanism (2) and may have a relative movement of a limited amplitude in a direction globally parallel to the axis of the connecting arm (1), in a way that when the mobile lock (25) is in a position defined as the initial position, (FIG. 10), the pin (374) of the braking device (37) comes in front of the notch (252) of the mobile lock (25), while the blocking element (21) leaves the notch (11) to become supported by the braking device (37). Consequently, the pin (374) penetrates inside the notch (252), pulling the mobile lock (25) in a translatory movement, whereas the pin (373) of the braking device (37) comes into contact with the suitable part (14) of the connecting arm (1) in order to reduce the relative motion between the mobile carriage (3) and the connecting arm (1), and while the blocking element (21) reaches the inclined ramps (32) of the mobile carriage (3), in the unlocked state of the blocking mechanism (2), (FIG. 12). The invention also provides that the mobile lock (25) is controlled by some elastic means (253), which are linked to the blocking mechanism (2) and which are intended to urge the mobile lock (25) back into the position defined here above as the initial position of the mobile lock (25), as soon as the pin (374) of the braking device (37) has left the notch (252), the said pin (374) no longer exerting any action relative to the mobile lock (25) (FIG. 12). From then, the pin (374) of the braking device (37) is no longer in front of the notch (252) of the mobile lock (25), in such a way that when the blocking mechanism (2) returns to its locked mode, as described here above, the pin (374) comes into sliding contact on the surface element (251) of the mobile lock (25), preventing the pin (373) of the braking device (37) to come into contact with the suitable part (14) of the connecting arm (1) (FIG. 13). In this way, during this re-locking phase, the braking device (37) no longer exerts any action relative to the connecting arm (1), easing the relative motion between the mobile carriage (3) and the connecting arm (1), when the blocking element (21) slides back over the inclined ramp (371) during the re-locking phase of the blocking mechanism (2), in accordance with the purpose described here before.

Figure 14:
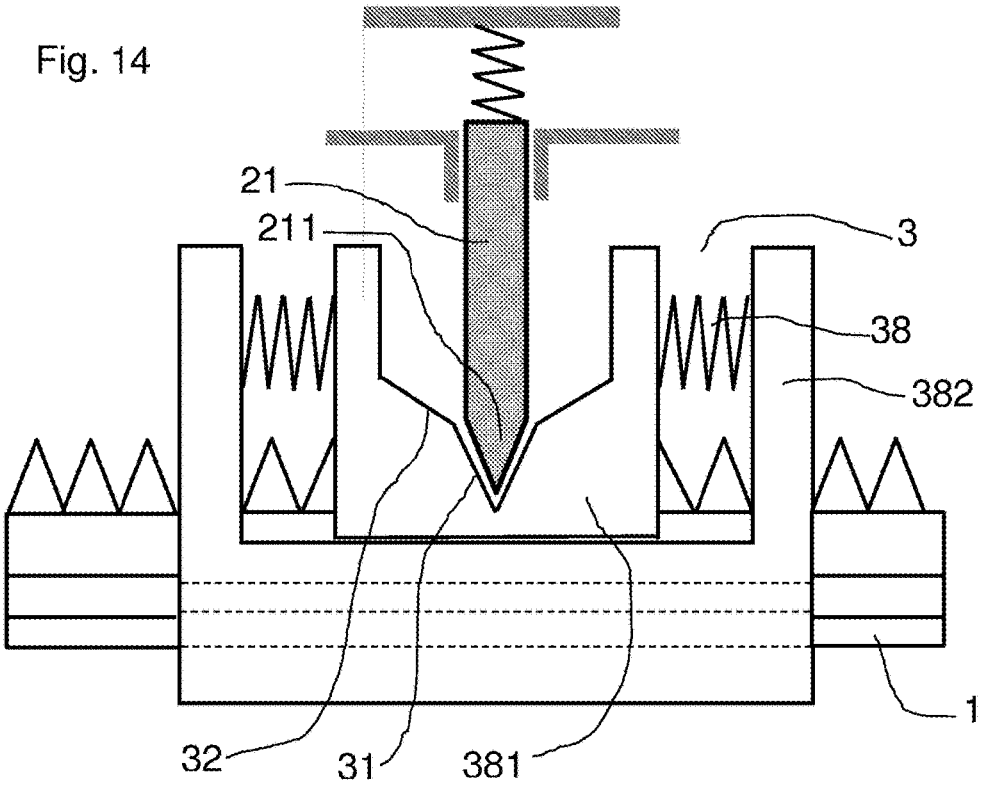
FIG. 14: variation of mobile carriage (3) comprising some elastic means (38).

Other variation of the mobile carriage (3) (FIG. 14): in a preferred embodiment, another variation of the mobile carriage (3) may be obtained by adding some elastic means (38), placed between 2 parts (381) and (382) of the mobile carriage (3), the said parts being mobile and able to slide along each other with a limited amplitude, in a direction globally parallel to the longitudinal axis of the connecting arm (1). The purpose pursued is to allow a compression of the elastic means (38) during the phase when the blocking element (21) leaves the notches (31) as a result of a load applied to the connecting arm (1), in such a way that, when the triangular extremity (211) of the said blocking element (21) reaches the inclined ramps (32), which slope is less steep than the slope of the sides of the notches (31), then the release of the elastic means (38) helps the triangular extremity (211) to reach the top of the inclined ramps (32). The part (381) of the mobile carriage (3) will comprise the notches (31) and the inclined ramps (32) described here above, with their description and functionalities unchanged from what has been described here above. Whereas the part (382) will comprise the remaining part of the mobile carriage (3), which may slide along the connecting arm (1) as described above, with the same embodiment and for the same purpose. According to a preferred embodiment, the parts (381) and (382) may slide along each other through the cooperation between 2 rectilinear surface elements which are pressed against each other and which respectively belong to the said parts (381) and (382). The mounting of the elastic means (38) will not be detailed here, but it may be glued or assembled with screws as an example, or any other way known by the skilled person.

Figure 15:
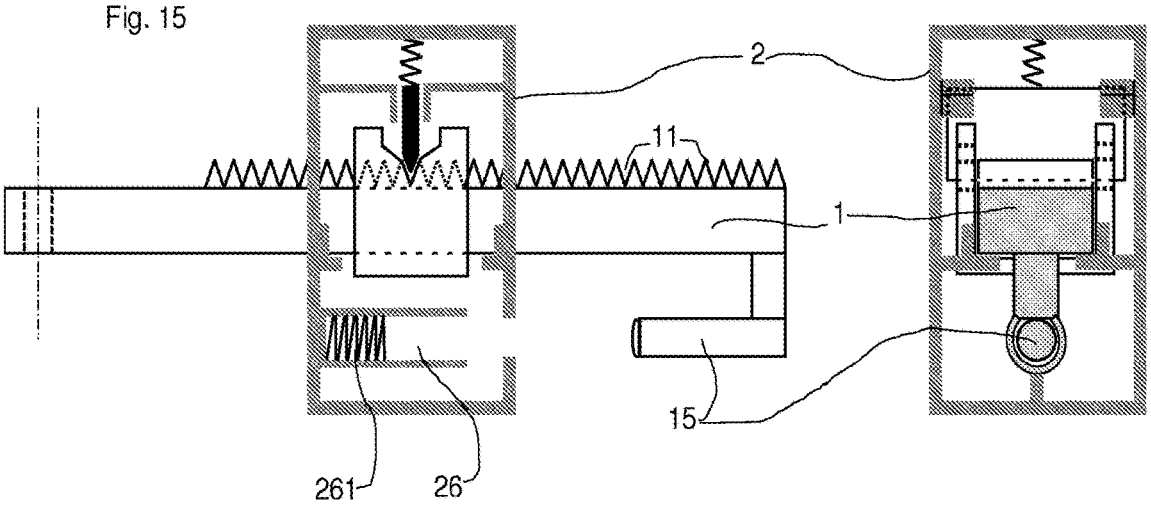
FIG. 15: variation of connecting arm (1) comprising a cylindrical part (15).

Variation of the connecting arm (1) (FIG. 15):

The connecting arm (1), described here above, provides the link between the frame of the door and the blocking mechanism (2), when the latter is mounted to the door. Conversely, if the blocking mechanism (2) is designed to be mounted to the frame of the door, then the connecting arm (1) provides the link between the door and the blocking mechanism (2).

In either case, during the opening or closing of the door, the connecting arm (1) transmits the effort resulting from the relative movement of the door, the blocking mechanism (2) being in the unlock mode. In addition, the connecting arm (1) transmits the loads resulting from the hold of the door in a steady open position, whenever the blocking mechanism (2) is in the locked mode. Also, when the door reaches the fully open position, it might be interesting, as it is the case on most state of the art door stop known mechanisms, to provide an end stop device, intended to make sure that the connecting arm (1) will secure the stop of the door in order to prevent the latter to move beyond its fully open position, which otherwise might damage the door or the body of the vehicle. The known state of the art end stop devices are generally designed as a hard stop, sometimes fitted with pads made of soft elastic material in order to reduce the shock whenever the door is opened in an abrupt way. Also, the invention provides that the connecting arm (1) may comprise at its free extremity, a cylindrical part (15), placed beside the said connecting arm (1), preferably located opposite of the side which comprises the notches (11), and this cylindrical part (15) being parallel to the longitudinal axis of the connecting arm (1). The said cylindrical part (15) will be designed to penetrate inside a cylindrical cavity (26), which is mounted to the blocking mechanism (2), the said cylindrical cavity (26) being itself designed in a way that its cross section be only merely larger than the cross section of the cylindrical part (15), in order that the penetration of this cylindrical part (15) inside the cylindrical cavity (26) takes place with a reduced clearance between the sides of those 2 parts, whenever the door gets fully opened. The purpose of this device is to encapsulate some compressed air inside the cylindrical cavity (26), as a result of the penetration of the cylindrical part (15), which then acts as a piston, and which therefore has a damping effect at the end of travel of the connecting arm (1). This damping effect will only be active as needed at the end of travel of the connecting arm (1), as there is no air tightness provided between the exterior of the cylindrical part (15) and the interior of the cylindrical cavity (26). Then, just after the connecting arm (1) has reached a stop at its travel end position, the leakage between the exterior of the cylindrical part (15) and the cylindrical cavity (26), will rapidly decrease the pressure of the air trapped inside the cylindrical cavity (26). The invention finally provides that an elastic element (261) may be placed inside the cylindrical cavity (26) in order to contribute to dampen the end of travel of the connecting arm (1). The elastic element (261) will not be described herein but may, as a not limitative example, be made of a helicoidal spring, an elastomeric bloc or any other element known in the state of the art that may be deformed as an elastic part.

The invention claimed is:

1. A door stop device, comprising:

a connecting arm (1); and a blocking mechanism (2), wherein one of the connecting arm (1) and the blocking mechanism (2), is fastened to the opening part of the door, the other of the connecting arm (1) and the blocking mechanism (2) being fastened to the frame of the door, wherein said connecting arm (1) comprises at least one side providing multiple successive retaining notches (11), in each of which a blocking element (21) is held, the blocking element (21) being connected to said blocking mechanism and mobile relative to the blocking mechanism (2), in a direction globally perpendicular to the connecting arm (1), said blocking element (21) being submitted to the force provided by elastic means (22), acting directly or indirectly on the blocking element (21), providing in this way the blocking function of the door stop device in multiple different positions, wherein:

a mobile carriage (3), may slide along said connecting arm (1) while providing some resistance to movement which may be obtained simply by some friction generated between two contacting surfaces belonging respectively to the connecting arm (1) and to the mobile carriage (3), whereas the mobile carriage (3) provides at least one notch (31), with a shape globally identical to the shape of the retaining notches (11) of the connecting arm (1), and the mobile carriage (3) also provides at least 2 inclined ramps (32) located on either side of said notch (31) of the mobile carriage (3);

said notch (31) of the mobile carriage (3) is designed to receive a part of an extremity (211) of the blocking element (21), in such a way that when the blocking element (21) is located inside a retaining notch (11) in a locked position, then the notch (31) of the mobile carriage (3) will be located beside and aligned with one of the retaining notches (11) of the connecting arm (1), due to the load exerted by the blocking element (21); and whenever the connecting arm (1) is submitted to a force greater than a given threshold, the blocking element (21) is moved apart from the set composed of one of the retaining notches (11) of the connecting arm (1) and of the notch (31) of the mobile carriage (3), up to the point where the blocking element (21) is no longer inside the retaining notch (11) of the connecting arm (1), said blocking element (21) being from this point, only held by one of the inclined ramps (32) of the mobile carriage (3), the connecting arm (1) then being no longer blocked in translatory movement by the blocking element (21).

2. The door stop device as described in claim 1, wherein the relative resistance to movement between the connecting arm (1) and the mobile carriage (3) is obtained by a braking device (34), which comprises a brake pad (341) linked to the mobile carriage (3) and pressed by elastic means (342) against a surface belonging to the connecting arm (1).

3. The door stop device as described in claim 2, wherein said door stop device is mounted to the door of a motor vehicle.

4. The door stop device as described in claim 2, wherein said door stop device is mounted to the door of a building.

5. The door stop device as described in claim 1, wherein the relative resistance to movement between the connecting arm (1) and the mobile carriage (3) is obtained by the deformation of a deformable part (13) located on one side of the connecting arm (1), which is pressed against an embossment (35) belonging to the mobile carriage (3).

6. The door stop device as described in claim 5, wherein said door stop device is mounted to the door of a motor vehicle.

7. The door stop device as described in claim 5, wherein said door stop device is mounted to the door of a building.

8. The door stop device as described in claim 1, wherein the relative resistance to movement between the connecting arm (1) and the mobile carriage (3) is obtained by the deformation of a deformable part (13), located on one side of the connecting arm (1), which is pressed against a cylindrical roll (36), which may freely rotate inside a cavity belonging to a part of the mobile carriage (3) and facing the deformable part (13).

9. The door stop device as described in claim 8, wherein said door stop device is mounted to the door of a motor vehicle.

10. The door stop device as described in claim 8, wherein said door stop device is mounted to the door of a building.

11. The door stop device as described in claim 1, wherein the elastic means (22) are formed by adding a transmission part (24), provided between the elastic means (22) and the blocking element (21), said transmission part (24) comprising at least two surface elements (241) and (242), having a surface with a curved portion, with some mobility relative to each other, whereas these surface elements (241) (242) may slide in two globally perpendicular directions relative to each other; whereas said surface elements (241) (242) cooperate in order to transfer the load provided by the elastic means (22), in a way that the direction of the force transmitted at the contact point (2412) between the surface elements (241) (242), may change while the elastic means (22) are being compressed.

12. The door stop device as described in claim 11, wherein said door stop device is mounted to the door of a motor vehicle.

13. The door stop device as described in claim 11, wherein said door stop device is mounted to the door of a building.

14. The door stop device as described in claim 1, wherein at least one braking device (37) is added to the mobile carriage (3), said braking device (37) being placed as a part of the inclined ramps (32) and providing inclined ramps (371) which take the place of a portion of said inclined ramps (32); the function of said braking device (37) being to limit the motion of the mobile carriage (3) relative to the connecting arm (1); conversely, during the re-locking phase of the blocking mechanism (2), said braking device (37) is inhibited by the means of a mobile lock (25) linked to the blocking mechanism (2), and mobile relative to the blocking mechanism (2) with a limited amplitude and in a direction globally parallel to the axis of the connecting arm (1), and in a way that, in the position defined as the initial position of said mobile lock (25), a pin (374) belonging to the braking device (37) comes in front of a notch (252) of the mobile lock (25), while the blocking element (21) exits one of the retaining notches (11) of the connecting arm (1), to be held by the braking device (37).

15. The door stop device as described in claim 1, wherein at least one elastic means (38) placed between two parts (381) (382) of the mobile carriage (3), added to the mobile carriage (3), in order that the elastic means (38) being compressed during the phase when the blocking element (21) is removed from the notches (31) as a result of a load applied to the connecting arm (1), then the release of the elastic means (38) just afterwards, helps the extremity (211) of the blocking element (21), to reach the top of the inclined ramps (32).

16. The door stop device as described in claim 1, wherein the connecting arm (1) comprises at its free extremity, a cylindrical part (15), placed beside said connecting arm (1), the axis of this cylindrical part (15) being parallel to the longitudinal axis of the connecting arm (1), the said cylindrical part (15) being designed to penetrate inside a cylindrical cavity (26) which is mounted to the blocking mechanism (2), said cylindrical cavity (26) being itself designed in a way that its cross section is merely larger than the cross section of the cylindrical part (15), in order that the penetration of this cylindrical part (15) inside the cylindrical cavity (26) takes place with a reduced clearance between the sides of those two latter parts, in order to encapsulate some compressed air inside the cylindrical cavity (26) as a result of the penetration of the cylindrical part (15), which then acts as a piston, and which therefore has a damping effect at the end of travel of the connecting arm (1).

17. The door stop device as described in claim 16, wherein said door stop device is mounted to the door of a building.

18. The door stop device as described in claim 1, wherein said door stop device is mounted to the door of a motor vehicle.

19. The door stop device as described in claim 1, wherein said door stop device is mounted to the door of a building.

20. The door stop device of claim 1, wherein said notch (31) is located side by side with the retaining notches (11) of the connecting arm (1) in such a way that with the blocking element (21) located inside the retaining notch (11) in the locked position, the notch (31) of the mobile element mobile carriage (3) will be located beside and aligned with one of the retaining notches (11) of the connecting arm (1), due to the load exerted by the blocking element (21).

* * * * *